US007033146B2

(12) United States Patent
Shi

(10) Patent No.: US 7,033,146 B2
(45) Date of Patent: Apr. 25, 2006

(54) SEALED MAGNETIC DRIVE SEALLESS PUMP

(75) Inventor: Chi-Wei Shi, Tao Yuan Hsien (TW)

(73) Assignee: Assoma Inc., Yuan Hsien (TW)

( * ) Notice: Subject to any disclaimer, the term of this patent is extended or adjusted under 35 U.S.C. 154(b) by 0 days.

(21) Appl. No.: 10/337,771

(22) Filed: Jan. 8, 2003

(65) Prior Publication Data

US 2004/0131485 A1 Jul. 8, 2004

(51) Int. Cl.
*F04B 17/03* (2006.01)

(52) U.S. Cl. ..... 417/370; 417/420; 417/423.12

(58) Field of Classification Search ..... 415/115; 417/370, 420, 423.12, 423.13
See application file for complete search history.

(56) References Cited

U.S. PATENT DOCUMENTS 4,013,384 A * 3/1977 Oikawa ..... 417/370
5,184,945 A * 2/1993 Chi-Wei ..... 417/420
5,464,333 A * 11/1995 Okada et al. ..... 417/420
5,641,275 A * 6/1997 Klein et al. ..... 417/420
6,443,710 B1 * 9/2002 Tatsukami et al. ..... 417/420

* cited by examiner

*Primary Examiner*—Michael Koczo, Jr.
(74) *Attorney, Agent, or Firm*—Bacon & Thomas PLLC

(57) ABSTRACT

A magnetic drive sealless pump. The pump includes a casing having a fluid suction opening and fluid discharge opening. A shell is combined to the rear part of the casing, and the exterior of the shell is combined with a bracket having a motor for impelling and rotating a drive magnet. At the center of the shell is provided with a shaft enveloped with a bearing having a spiral fluid passage at the interior thereof. A capsule is provided between the bearing and the shell and at the interior of the capsule is provided with a driven magnet situated between the bearing and the drive magnet. The capsule is also extended into the casing and at the front of the capsule is provided with impeller. The impeller, capsule and bearing are integrated into one body for forming a rotating member having a thrust ring at the front and rear parts thereof, respectively, for preventing axial movements of the rotating member. Between the bearing and the capsule is an auxiliary circulating channel for cooling that has a convection effect for cooling at both the interior and exterior of the bearing without increasing the fluid leakage thereof, thereby preventing high temperatures from dry running of the pump.

7 Claims, 3 Drawing Sheets

SEALED MAGNETIC DRIVE SEALLESS PUMP

BACKGROUND OF THE INVENTION (a) Field of the Invention

The invention relates to a magnetic drive sealless plump having an auxiliary circulating channel for cooling between the bearing and the capsule thereof, such that cooling effect by convection exists at both the interior and exterior of the bearing thereof, thereby ensuring that excessive heat is not produced.

(b) Background of the Invention

FIG. 1 shows a prior magnetic drive centrifugal pump, which includes a casing 100 combined with a shell 200. At the front part of the casing 100 is a suction opening 101 and at the top thereof is a discharge opening 102. At the center of the shell 200 is a shaft 201 enveloped with a bearing 202 further enveloped with a capsule 203. In the capsule 203 is a driven magnet 204 and the capsule 203 is extended forward into the casing 100. At the front of the capsule 203 is positioned an impeller 205. During the rotation of the impeller 205, the fluid thereof is lifted from the suction opening 101 to the discharge opening 102 through the impeller 205. The driven magnet 204 is driven by the drive magnet 206 which is attached to a motor. And between these two magnets is a shell 200 to prevent entry of liquid from the outside. In a normal operation of the pump, the pressure difference between the input and output of the impeller 205 is employed to have a small amount of fluid thereof flow to the rear part of the impeller 205 through the passage between the outer side of the capsule 203 and the inner side of the shell 200, and heat produced is taken away through a groove between the bearing 202 and the shaft 201. Among the circulation route thereof (gaps A, B, C, D, and E), only gaps D and E have a convection effect for cooling. Thrust rings 207 are positioned adjacent the impeller 205 and the capsule 203.

However, in an abnormal operation of the pump caused by malfunctions of control instruments, mishandling during operation, congestion caused by waste fluid, or insufficient suction liquid level for instance, may cause the pump to perform dry running. Since the medium of convection for cooling is air, which can only carry away a limited amount of heat, and therefore the temperature of the bearing 202 and the shaft 201 is rapidly elevated, thus resulting in serious damage of the pump. Once dry running takes place, the bearing 202 and the shaft 201 are abraded, and the capsule 203 is also deformed from the heat produced. More particularly, the capsule 203 is generally made of plastic that deforms easily from heat, further increasing the abrasion due to the dry running, and therefore the pump becomes unfit for its application.

In order to prevent deformation of the capsule 203 from heat, provision of additional heat resistant materials to the inner periphery of the capsule 203 has been attempted. However, the addition of the heat resistant materials thereof not only complicates the manufacturing process and increases the production cost, but also has unsatisfactory effects due to long-term dry running of the pump that causes the temperature of the bearing 202 and the shaft 201 to rise up to 220° C. Therefore, if heat produced is held within the pump in a contained manner, the result is unsatisfactory.

SUMMARY OF THE INVENTION

An object of the invention is to provide cooling effect by convection at both the interior and exterior of a bearing by disposing an auxiliary circulating channel for cooling purposes without increasing the amount of fluid leakage, thus achieving an optimal cooling effect and preventing damage of the pump from heat when dry running occurs.

The other object of the invention is to strengthen the bearing and keep it structurally unaffected from the additional channel using an external groove between the capsule and the bearing by paring the outer periphery of the bearing.

DESCRIPTION OF THE PREFERRED EMBODIMENTS

Figure 1:
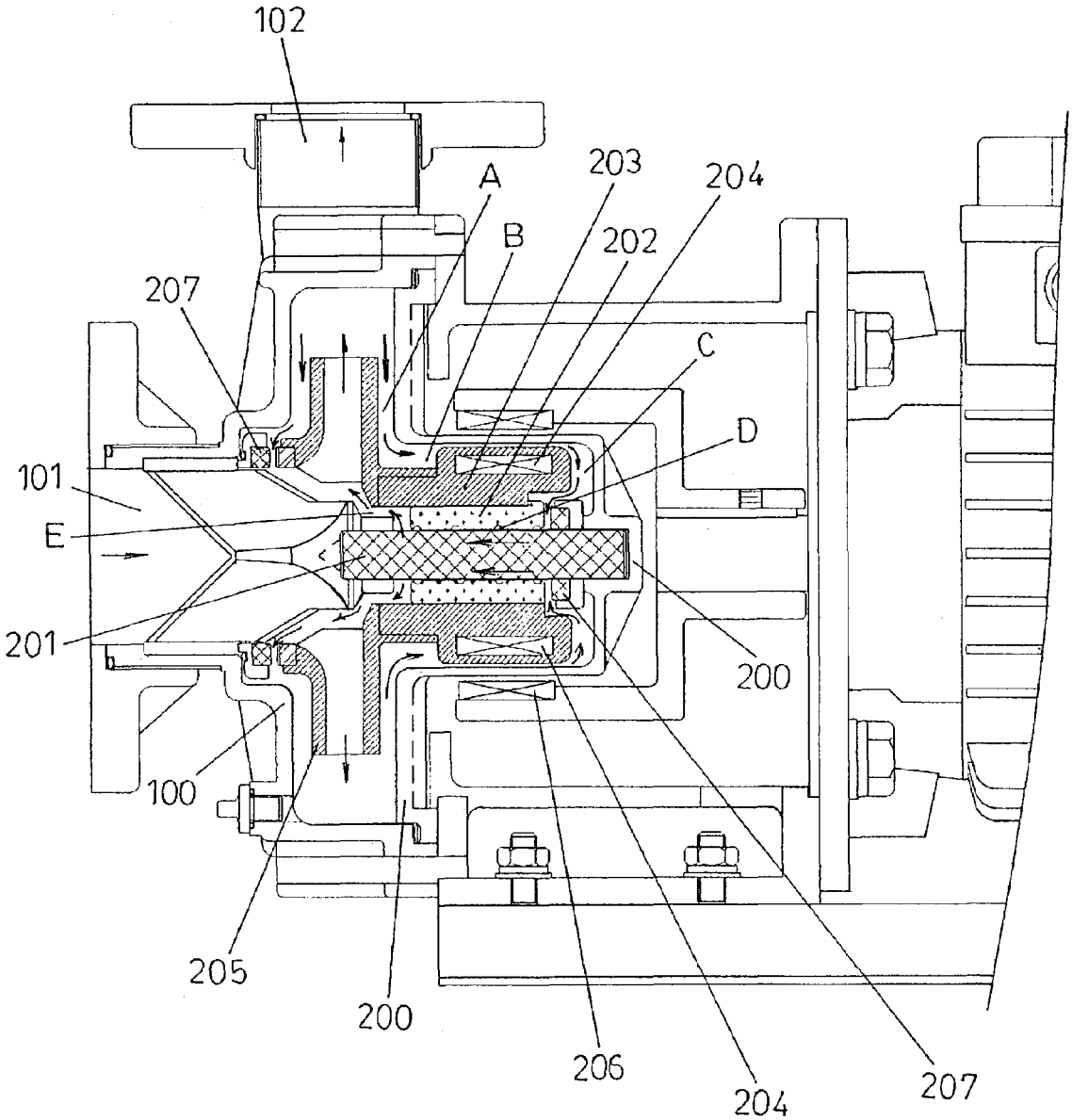
FIG.1 (PRIOR ART)
FIG. 1 is a sectional view showing a prior product.
Figure 2:
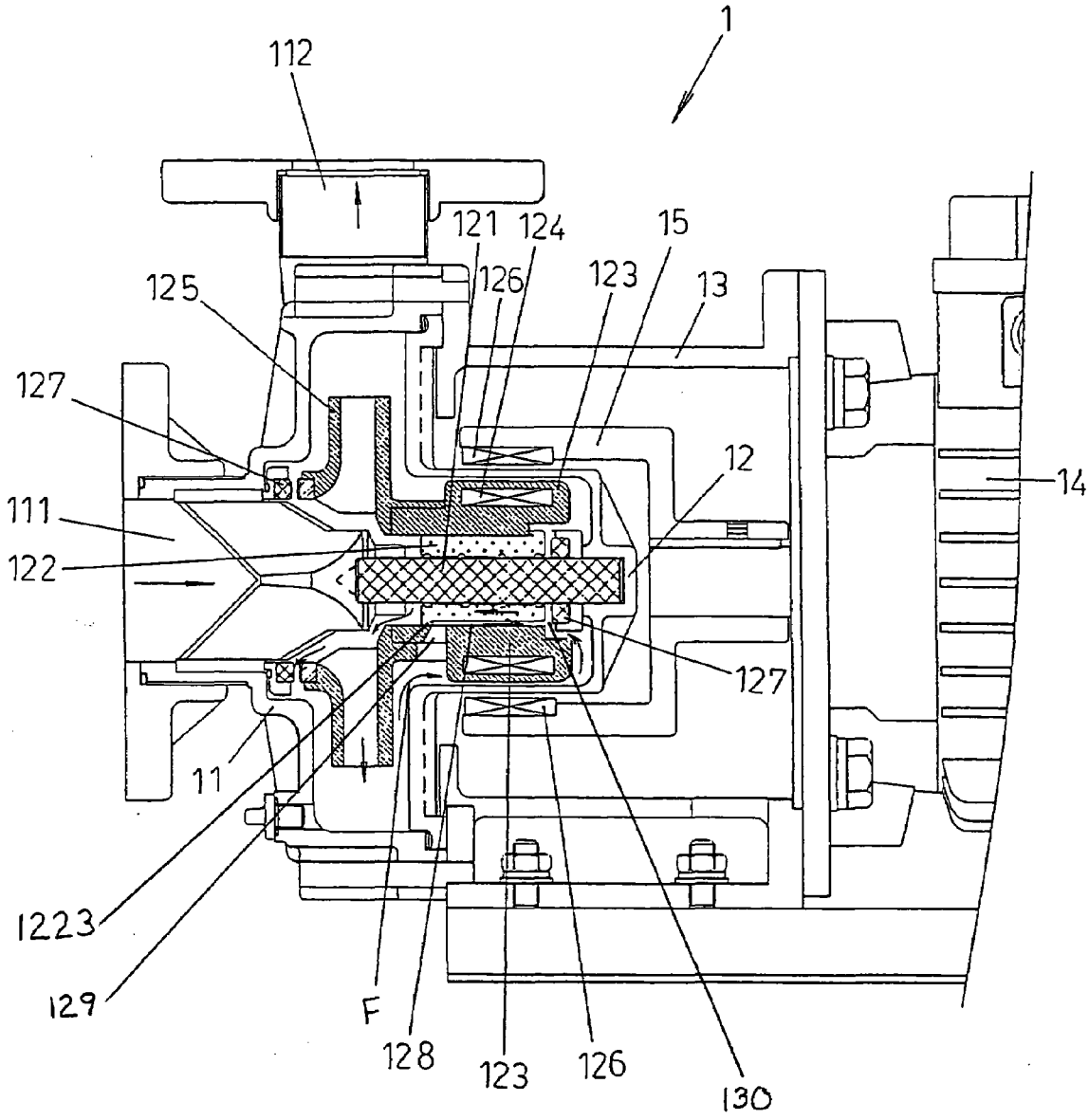
FIG. 2 is a sectional view showing the present invention.
Figure 3:
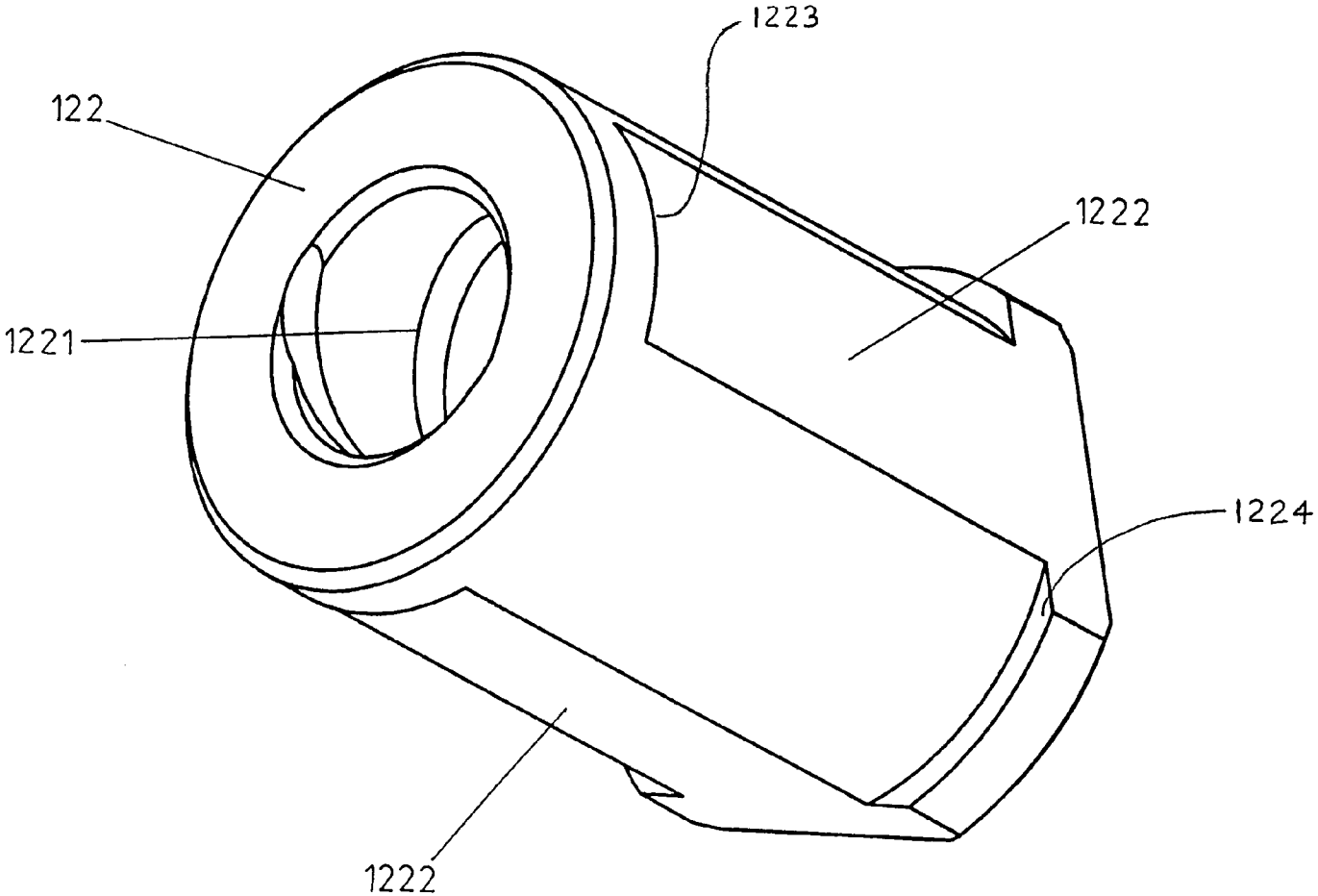
FIG. 3 is a diagram showing the outer appearance of the bearing in accordance with the invention.

Referring to FIG. 2, in accordance with the invention, the pump 1 comprises a casing 11 having a fluid suction opening 111 and a fluid discharge opening 112, and a shell 12 combined to the rear of the casing 11. The exterior of the shell 12 is combined with a bracket 13 having a drive motor 14 behind it. The center of the shell 12 receives a shaft 121 enveloped with a bearing 122 that is further enveloped with a capsule 123. In the interior of the capsule 123 receives a driven magnet 124 and the capsule 123 is extended forward into the casing 11. The impeller 125 is disposed at the front of the capsule 123 and a drive magnet 126 is disposed in a yoke 15 covering the rear part of the shell 12 such that drive magnet 126 is situated at the exterior of the driven magnet 124. The drive magnet 126 is impelled and rotated by the rotation of the motor 14, such that the driven magnet 124 is also rotated along with the capsule 123, the bearing 122 and the impeller 125. The fluid therein is then forwarded to the discharge opening 112 from the suction opening 111 through the impeller 125. The front part of the capsule 123 is provided with the impeller 125, and the impeller 125, the capsule 123 and the bearing 122 are integrated into one body as a rotating member of the pump. At the front and rear parts of the rotating member are positioned with respective thrust rings 127, for preventing axial movements of the rotating member. In the meantime, a gap is formed from the rear part of the impeller 125 to the outer periphery of the capsule 123 and along the rear part of the bearing 122. The gap is further extended through a screw groove 1221 provided in advance (as shown in FIG. 3) to the interior of the impeller 125, thus forming a channel for fluid circulation (as indicated by the arrow) to achieve a cooling effect.

The characteristics of the invention are that the between the bearing 122 and the capsule 123 there is provided with a circulating channel for cooling of the bearing, and convection effect for cooling exists at both the interior and exterior of the bearing 122. The bearing 122, apart from the screw groove 1221 (i.e. spiral groove) disposed at the interior thereof, at the outer periphery thereof is also configured with symmetrical ramps 1222 (as shown in FIG. 3) for forming channels 128 (shown in FIG. 2) between the capsule 123 and the bearing 122. That is, the outer periphery of the bearing is configured to form chord-wise planar ramps 1222. In the embodiment illustrated in FIG. 3, three (3) planar ramps 1222 are formed such that the cross-section of the bearing 122 is roughly triangular. Each of the planar ramps 1222 terminates near a forward end of the bearing 122 at an end wall 1223. At a rear end of the bearing 122, a perimeter flange is formed and separated by the planar ramps 1222 into plural flange segments 1224. The channels 128 are in fluid communication with the screw groove 1221 through a rear gap 130 between the rear end of the bearing 122 and the thrust bearing 127, forming a convective cooling passage inclusive of the channels 128, the gap, and the screw groove 1221. The channels 128 allow for convection (as indicated by the arrow), along with the screw groove 1221, whereby an optimal cooling effect is provided at both the interior and exterior of the bearing 122. Therefore, when the pump 1 runs dry, sufficient ventilation is still provided for cooling in order to keep the bearing 122 at low temperatures.

With reference to FIG. 2, it can be seen that a fluid passage 129 is formed in the capsule 123 in communication with each channel 128 near the forward (impellor) end of the bearing 122, immediately behind the end wall 1223. It can be seen that the fluid passage 129 brings channels 128 into fluid communication with the interior of the casing 11 surrounding the impellor 125. As indicated by the directional flow arrow F, at least some fluid pumped by the impellor 125 is circulated behind the impellor 125 and toward the fluid passage 129.

Conclusive from the above, in accordance wit the present invention, an auxiliary circulating channel for cooling is provided between the bearing and the capsule, and an external groove is formed along with the capsule. The external groove having a relatively simple structure does not affect the structural strength of the bearing, but also ensures that the bearing maintains low temperatures by providing the pump with an optimal cooling effect when the pump is under dry running conditions, thereby reducing the effects of wear and lengthening the life cycle of the pump. And while this invention has been particularly shown and described with references to preferred embodiments thereof, it will be understood by those skilled in the art that various changes and adaptions may be made therein without departing from the true spirit and scope of the invention as defined by the appended claims.

What is claimed is:

1. A magnetic drive sealless pump comprising:

a casing having a fluid suction opening and a fluid discharge opening;

a shell combined to a rear part of the casing, an exterior of the shell is provided with a bracket disposed with a motor for driving and rotating a drive magnet;

a center of the shell is provided with a shaft enveloped with a bearing, the bearing having an outer periphery configured with a plurality of chord-wise planar ramps, and an interior of the bearing is provided with a spiral fluid passage;

a capsule positioned between the bearing and the shell, an interior of the capsule houses a driven magnet situated between the bearing and the drive magnet, the capsule is extended into the casing, and a front part of the capsule is provided with an impeller;

the impeller, the capsule and the bearing are integrated together to form a rotating member of the pump, and at front and rear parts of the rotating member are each provided with a thrust ring for preventing axial movements of the rotating member; and a plurality of channels are formed between the bearing and the capsule by said chord-wise planar ramps, the channels along with the spiral fluid passage forming a convective cooling passage, whereby a convective cooling effect is provided at both the interior and an exterior of the bearing to prevent overheating due to dry running.

2. The magnetic drive sealless pump according to claim 1, wherein the outer periphery of the bearing is configured to form three chord-wise planar ramps such that the bearing has a roughly triangular cross-section.

3. The magnetic drive sealless pump according to claim 2, wherein gaps are formed from the rear part of the impeller to the rear part of the capsule and along the rear part of the bearing and forms a convection channel with the internal spiral fluid channel.

4. The magnetic drive sealless pump according to claim 1, wherein a gap is formed from the rear part of the impeller to the outer periphery of the capsule and along the rear part of the bearing and forms a convection channel with the internal spiral fluid channel.

5. The magnetic drive sealless pump according to claim 1, wherein a gap is formed from the rear part of the impeller to the interior periphery of the capsule and along the rear part of the bearing and forms a convection channel with the internal spiral fluid channel.

6. The magnetic drive sealless pump according to claim 1, further comprising a fluid passage defined in said capsule in fluid communication between an interior region of said casing and each of said channels near a forward end of said bearing.

7. A magnetic drive sealless pump comprising:

a casing having a fluid suction opening and a fluid discharge opening;

a shell combined to a rear part of the casing, an exterior of the shell is provided with a bracket disposed with a motor for driving and rotating a drive magnet;

a center of the shell is provided with a shaft enveloped with a bearing, the bearing having an outer periphery configured with a plurality of chord-wise planar ramps, an interior of the bearing being provided with a spiral fluid passage;

a capsule positioned between the bearing and the shell, an interior of the capsule houses a driven magnet situated between the bearing and the drive magnet, the capsule is extended into the casing, and a front part of the capsule is provided with an impeller;

a plurality of channels defined between said bearing and said capsule by said chord-wise planar ramps;

at least one fluid passage defined in said capsule in fluid communication between an interior region of said casing and each of said channels near a forward end of said bearing, whereby a fluid propelled by said impellor is propelled through said at least one fluid passage toward said channels;

the impeller, the capsule and the bearing are integrated together to form a rotating member of the pump, and at front and rear parts of the rotating member are each provided with a thrust ring for preventing axial movements of the rotating member;

a plurality of channels are formed between the bearing and the capsule by said chord-wise planar ramps, the channels along with the spiral fluid passage forming a convective cooling passage, whereby a convective cooling effect is provided at both the interior and an exterior of the bearing to prevent overheating due to dry running.

* * * * *